US006088000A

United States Patent [19]

Ho

[11] Patent Number: 6,088,000

[45] Date of Patent: Jul. 11, 2000

[54] QUADRIFILAR TAPERED SLOT ANTENNA

[75] Inventor: Chien H. Ho, San Diego, Calif.

[73] Assignee: Garmin Corporation, Taipei, Taiwan

[21] Appl. No.: 09/263,174

[22] Filed: Mar. 5, 1999

[51] Int. Cl.[7] ..... H01Q 13/10; H01Q 1/36

[52] U.S. Cl. ..... 343/770; 343/767; 343/895

[58] Field of Search ..... 343/767, 768, 343/770, 895, 700 MS; H01Q 13/10, 1/36

[56] References Cited

U.S. PATENT DOCUMENTS

| | | | |
|---|---|---|---|
| D. 363,488 | 10/1995 | Shumaker | D14/230 |
| 2,665,381 | 1/1954 | Smith et al. | 250/33 |
| 2,877,427 | 3/1959 | Butler | 333/9 |
| 4,012,744 | 3/1977 | Greiser | 343/895 |
| 4,203,070 | 5/1980 | Bowles et al. | 375/1 |
| 4,297,707 | 10/1981 | Brunner et al. | 343/725 |
| 4,451,830 | 5/1984 | Lucas et al. | 343/768 |
| 4,612,543 | 9/1986 | DeVries | 343/5 |
| 4,675,691 | 6/1987 | Moore | 343/908 |
| 4,843,403 | 6/1989 | Lalezari et al. | 343/767 |
| 5,068,670 | 11/1991 | Maoz | 343/767 |
| 5,200,757 | 4/1993 | Jairam | 343/786 |
| 5,216,430 | 6/1993 | Rahm et al. | 343/700 |
| 5,255,005 | 10/1993 | Terret et al. | 343/895 |
| 5,353,040 | 10/1994 | Yamada et al. | 343/895 |
| 5,427,032 | 6/1995 | Hiltz et al. | 102/336 |
| 5,955,997 | 9/1999 | Ho et al. | 343/767 |

*Primary Examiner*—Don Wong
*Assistant Examiner*—Hoang Nguyen
*Attorney, Agent, or Firm*—Shook, Hardy & Bacon L.L.P.

[57] ABSTRACT

A tapered slot quadrifilar antenna for GPS receivers. The antenna has a cylindrical dielectric body covered with a conductive coating. Four helical slots are formed in the antenna and extend around one half of its circumference to provide a right hand circular polarization for receiving GPS signals. A microstrip feed system is provided and is arranged to create balanced currents along both sides of each slot so that the impedance transformation is not adversely affected. Each slot has a narrow upper end and a wide lower end and a progressively greater width from the narrow end to the wide end.

21 Claims, 2 Drawing Sheets

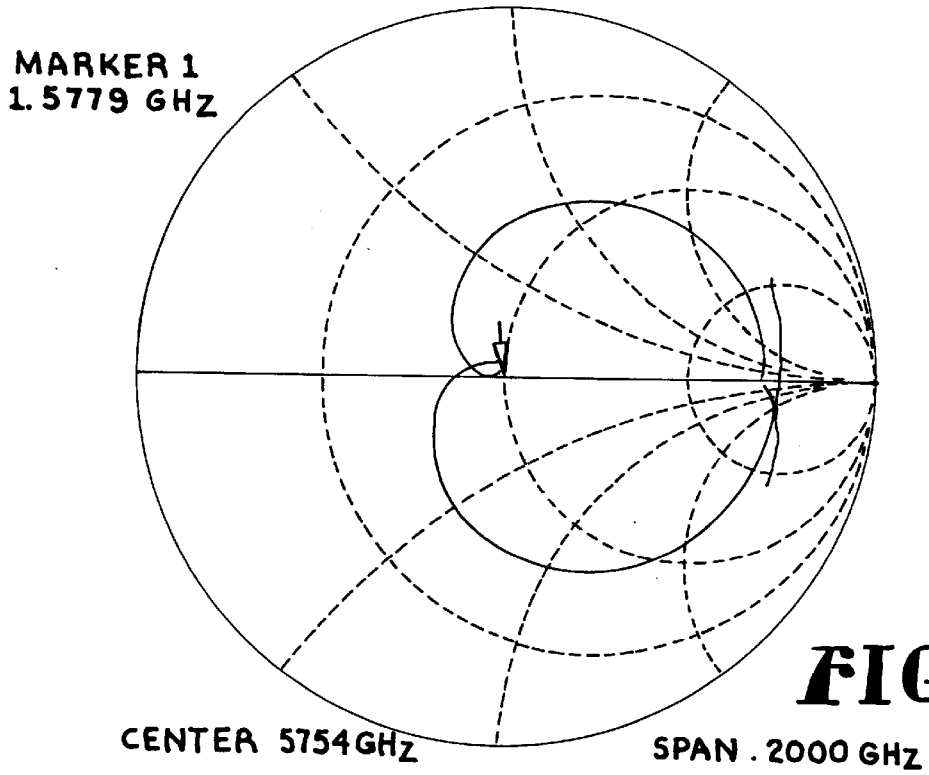
FIG. 2.
FIG. 3.
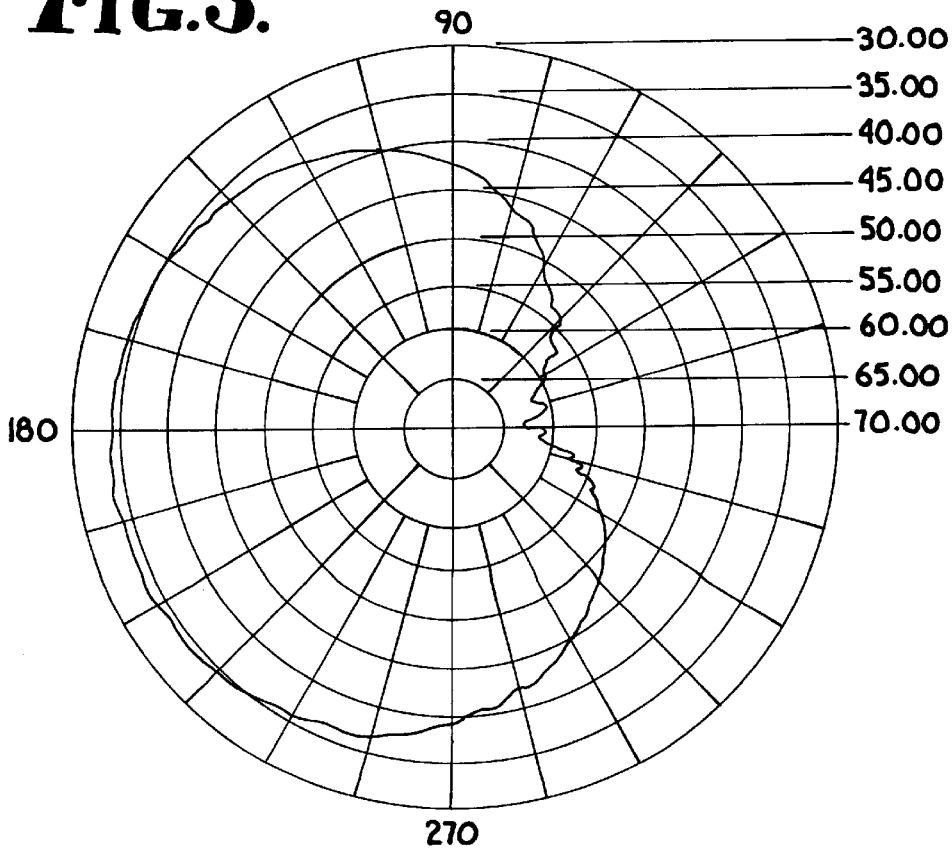

QUADRIFILAR TAPERED SLOT ANTENNA

FIELD OF THE INVENTION

This invention relates generally to cylindrical slot antennas and deals more particularly with a slot antenna in which helical slots are tapered in order to enhance the horizon coverage for receiving low elevation signals such as those emitted from GPS satellites.

BACKGROUND OF THE INVENTION

In recent years, the global positioning system (GPS) has been instrumental in advancing the practical utility of satellite communications in a variety of applications. In order to take full advantage of the capabilities offered by GPS satellite transmissions, antennas that provide a right hand circular polarization are necessary. Good coverage near the horizon is also necessary so that low elevation satellites can be effectively tracked. Antennas having crossing slots have been proposed, as have a variety of cylindrical slot antennas. Slot antennas typically include slots that are uniform in width and are used with microstrip feed systems. Cylindrical slot antennas have many advantageous characteristics, including broad beam pattern production, light weight, amenability to mass production, and simple feeding and matching techniques. However, the cylindrical slot antennas that have been proposed in the past have not been entirely satisfactory with respect to their ability to provide effective horizon coverage of low elevation signals.

SUMMARY OF THE INVENTION

Accordingly, it is evident that a need exists for a GPS antenna that is improved in its ability to track satellites at low angles of elevation. It is the principal goal of the present invention to meet that need. The invention is also directed to a GPS antenna that exhibits good impedance matching and a good front/back ratio.

More specifically, it is an object of the invention to provide an antenna that is improved functionally and which takes advantage of the practical benefits of slot antennas, such as suitability for low cost mass production, lightweight, a compact configuration, broad beam pattern capabilities, and simplicity in feeding and matching techniques.

In accordance with the present invention, a resonant quadrifilar structure is provided by forming four tapered helical slots in a cylindrical antenna in order to improve the antenna tracking near the horizon. The base of the antenna is formed as a cylinder which is preferably constructed from a dielectric laminate. The outer surface of the cylinder is coated with a conductive material that provides an electrical ground for a microstrip feed line system. The slots are etched in the coating starting at one end of the cylinder and terminating well short of the opposite end. Each slot extends around approximately one half of the circumference of the cylinder.

Each slot is tapered from bottom to top to provide a more uniform current flow and a loop-dipole radiation pattern. This in turn improves the horizon coverage and maintains a good cardioid shaped radiation pattern. Each slot has its narrow top end at the upper edge of the antenna and its wide end shorted at a location well away from the bottom end of the antenna. Each slot progressively widens from its narrow upper end to its wide lower end.

Microstrip feed lines are connected with an electric circuit and include transverse portions that cross the slots at right angles. Longitudinal portions of the feed lines extend from the transverse portions and are generally parallel to the tapered slots. The end of each feed line terminates in an open circuit at the feed point. The longitudinal portions of the slots have lengths that are equal to about one fourth wavelength of the GPS signals that are received. The resonant quadrifilar structure provides the necessary right hand circular polarization and increases the radiation coverage in the horizontal plane, while providing enhanced coverage near the horizon.

Other and further objects of the invention, together with the features of novelty appurtenant thereto, will appear in the course of the following description.

BRIEF DESCRIPTION OF THE DRAWINGS

In the accompanying drawings which form a part of the specification and are to be read in conjunction therewith and in which like reference numerals are used to indicate like parts in the various views:

FIG. 2 is a diagrammatic view showing the measured frequency response of the input impedance of the quadrifilar slot antenna of the present invention; and FIG. 3 is a diagrammatic view showing the radiation pattern of the slot antenna of the present invention.

DETAILED DESCRIPTION OF THE INVENTION

Figure 1:
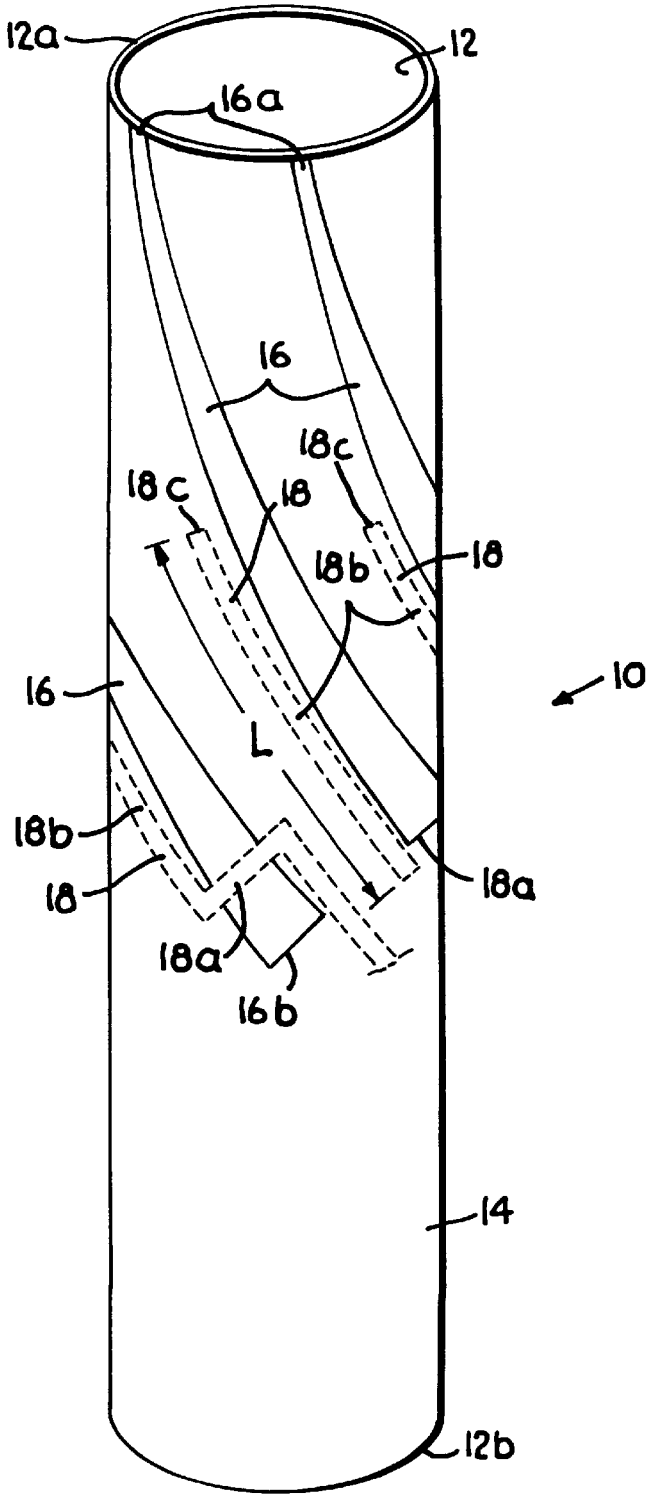
FIG. 1 is a perspective view of a quadrifilar tapered slot antenna constructed according to a preferred embodiment of the present invention, with microstrip feed lines being only partially shown for purposes of clarity.

Referring now to the drawings in more detail and initially to FIG. 1, numeral 10 generally designates a printed quarter wavelength quadrifilar slot antenna constructed in accordance with the present invention. The antenna 10 has a body 12 which may be constructed of a dielectric laminate having the shape of a hollow cylinder. The body 12 should be nonconductive and is preferably a dielectric constructed of KAPTON material (KAPTON is a registered trademark of E. I. DuPont Nemours & Co.). Other suitable materials can be used to construct the body 12 of the antenna.

The cylindrical outer surface of the body 12 is provided with a thin coating 14 which coats the outside of the antenna 10. The coating 14 is constructed of a suitable electrically conductive material such as a metal. The coating 14 provides an electrical ground for microstrip feed lines which will subsequently be described.

The antenna 10 may have a cap (not shown) which includes a conductive material that is in contact with the coating 14 when the cap is in place on the top end 12*a* of the antenna body 12.

Four helical radiating slots 16 are formed through the antenna 10 and extend through the body 12 and the coating 14. Each of the radiating slots 16 has a spiral or helical configuration and extends into the top end of the antenna 10. Each slot 16 extends helically around approximately one-half of the circumference of the antenna 10 and terminates in a bottom end that is located well above the lower end 12*b* of the body 12. The slots 16 are spaced equidistantly apart and are parallel to one another. The slots 16 may be etched in the coating 14 using conventional techniques.

It is a particular feature of the invention that each of the slots 16 is tapered. Each slot 16 has a relatively narrow upper end 1 6*a* that is an open end adjacent to the top end 12*a* of the antenna body 12. The opposite or lower end 16*b* of each slot is a shorted end which is considerably wider than the upper end 16*a*. End 16*b* is located well above the lower end 12*b* of the body 12. Each slot 16 gradually and progressively widens as it extends in a helical curve from the narrow upper end 16*a* to the wide lower end 16*b*.

A conventional hybrid electrical circuit (not shown) is connected with microstrip feed lines which are identified by numeral 18. Each of the slots 16 is provided with one of the feed lines 18. The lower end portion of each feed line 18 connects with the hybrid circuit and the lower portions of the feed lines 18 extend upwardly slightly above the wide lower ends 16*b* of the corresponding slots 16. Each feed line 18 includes a relatively short transverse portion 18*a* which extends across the corresponding slot 16 at a right angle to the longitudinal axis of the slot. Each of the transverse portions 18*a* extends from the upper end of the leg of the feed line 18 which connects with the hybrid electrical circuit.

Each feed line 18 also includes a longitudinal portion 18*b* which extends generally upwardly from the transverse portion 18*a*. Each longitudinal portion 18*b* extends along and parallel to the corresponding slot 16. The longitudinal portion 18*b* of each feed line 18 terminates in an end 18*c* which is an open circuit providing the feed point. The end 18*c* is spaced from the transverse portion 18*a* of the same feed line by a distance L which defines the length of the longitudinal portion 18*b*. The distance L is equal to approximately ¼ λ, where λ is the wavelength of the GPS signals which the antenna is to receive.

The arrangement of the feed lines 18 relative to the slots 16 results in balanced current flowing on both sides of each of the radiating slots 16 so that there is only minimal effect on the impedance transformation. At the same time, the tapered quadrifilar structure provides the right hand circular polarization which is necessary and improves the horizon coverage and VSWR.

FIG. 2 shows the measured frequency response of the input impedance for the antenna 10. The antenna is resonant at 1.5754 Ghz (the GPS frequency) with input impedance of 49+j2 Ω.

The return loss at the center frequency is greater than 30 dB. The cardioid radiation pattern of the antenna 10 is depicted in FIG. 3. The half power beam width is more than 120° and the front/back ratio is greater than 20 dB. This is generally considered to be a favorable ratio for the resistance of multipath signals from the ground.

The quarter wavelength quadrifilar slot antenna 10 was verified by conducting a field test using a Garmin GPS 90™ receiver. The test was conducted under a satellite geometry with Position Dilution of Precision (PDOP) of 70 ft. The results of the test indicate that satellites 2, 7, 15, 19, and 27 located within the axis angle of θ=±45° have calibrated signal scales of 10, 7, 7, 8, and 9, corresponding to receiver phase noise 53 dB, 47 dB, 47 dB, and 51 dB, respectively.

Satellites 13, 26, and 31 located outside the axis angle of θ=±45° have calibrated signal scales of 6, 7, and 5, corresponding to receiver phase noise of 45 dB, 47 dB, and 43 dB respectively. These test results indicate a radiation pattern coverage of the antenna 10 that permits it to effectively track satellites near the horizon at very low elevation angles.

The construction of the antenna 10 and the pattern and relationship of the slots 16 and feed lines 18 result in good input impedance matching, a good front/back ratio, and improved horizon coverage. At the same time, the known advantages of cylindrical slot antennas are achieved, including low cost manufacturing, light weight, compact size, ease of fabrication and assembly, and simple feeding and matching techniques.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. An antenna for electromagnetic signals, comprising:

a nonconductive cylindrical body having an outside surface;

a conductive coating on said outside surface of said body;

a plurality of slots in said coating extending in a helical pattern around said body, each slot having opposite ends with one end having a lesser width dimension across the slot than the opposite end; and a feed line for each slot having a transverse portion extending across the slot and a longitudinal portion extending generally along and parallel thereto.

2. An antenna as set forth in claim 1, wherein said body has upper and lower ends and said one end of each slot is closer to said upper end than to said lower end.

3. An antenna as set forth in claim 2, wherein said one end of each slot is adjacent to said upper end of the body.

4. An antenna as set forth in claim 3, wherein said opposite end of each slot is spaced from said lower end of the body.

5. An antenna as set forth in claim 4, wherein said slots are spaced substantially equidistantly apart and are substantially parallel.

6. An antenna as set forth in claim 1, wherein said slots are spaced substantially equidistantly apart and are substantially parallel.

7. An antenna as set forth in claim 1, wherein said cylindrical body comprises a dielectric.

8. An antenna as set forth in claim 1, wherein said cylindrical body comprises a laminate.

9. An antenna as set forth in claim 1, wherein said coating provides an electrical ground for said feed lines.

10. An antenna as set forth in claim 1, wherein said longitudinal portion of each feed line terminates in an open circuit.

11. An antenna as set forth in claim 1, wherein said longitudinal portion of each feed line has an end and a length L between the transverse portion thereof and said end thereof, said length L being approximately ¼ λ where λ is the wavelength of a GPS signal to be received by the antenna.

12. An antenna as set forth in claim 11, wherein said end of the longitudinal portion of each feed line terminates in an open circuit.

13. An antenna as set forth in claim 1, wherein each slot extends helically around said body approximately one half of the circumference thereof.

14. An antenna as set forth in claim 1, wherein the transverse portion of each feed line is oriented substantially perpendicular to the corresponding slot.

15. An antenna as set forth in claim 14, wherein said longitudinal portion of each feed line has an end and a length L between the transverse portion thereof and said end thereof, said length L being approximately ¼ λ where λ is the wavelength of a GPS signal to be received by the antenna.

16. An antenna as set forth in claim 15, wherein said end of the longitudinal portion of each feed line terminates in an open circuit.

17. A cylindrical slot antenna, comprising:

a nonconductive cylindrical body having opposite first and second ends and an outside surface;

a conductive coating on said outside surface;

a plurality of slots in said coating each having a narrow end adjacent said first end of said body and a wide end spaced from said second end of said body, each slot extending around said body in a helical pattern and having a greater width at said wide end than at said narrow end; and a feed line for each slot connected with an electric circuit, each feed line having a transverse portion extending across the corresponding slot and a longitudinal portion extending generally along and parallel thereto.

18. An antenna as set forth in claim 17, wherein said slots are spaced substantially equidistantly apart and are substantially parallel.

19. An antenna as set forth in claim 18, wherein each slot extends helically around said body approximately one half of the circumference thereof.

20. A cylindrical slot antenna, comprising:

a hollow cylindrical body constructed of nonconductive material, said body having an outside surface and opposite first and second ends;

a conductive coating on said outside surface;

a plurality of slots in said coating extending in a helical pattern and each having a relatively narrow end and a relatively wide end, each slot having the narrow end thereof adjacent said first end of said body and progressively increasing in width from said narrow end toward said wide end; and a feed line for each slot connected with an electric circuit, each feed line having a transverse portion extending across the corresponding slot and a longitudinal portion extending generally along and parallel thereto.

21. An antenna as set forth in claim 20, wherein said wide end of each slot is spaced from said second end of the body.

* * * * *